US010206544B2

(12) United States Patent
Hsieh

(10) Patent No.: US 10,206,544 B2
(45) Date of Patent: Feb. 19, 2019

(54) SOAP HOLDER

(71) Applicant: Jen-Yi Hsieh, New Taipei (TW)

(72) Inventor: Jen-Yi Hsieh, New Taipei (TW)

( * ) Notice: Subject to any disclaimer, the term of this patent is extended or adjusted under 35 U.S.C. 154(b) by 0 days.

(21) Appl. No.: 15/372,495

(22) Filed: Dec. 8, 2016

(65) Prior Publication Data

US 2017/0164792 A1 Jun. 15, 2017

(30) Foreign Application Priority Data

Dec. 10, 2015 (CN) ..... 2015 1 0916126

(51) Int. Cl.
*A47K 5/02* (2006.01)
*A47K 5/08* (2006.01)
*A47K 5/04* (2006.01)

(52) U.S. Cl.
CPC ..... *A47K 5/08* (2013.01); *A47K 5/04* (2013.01); *A47K 5/02* (2013.01)

(58) Field of Classification Search
USPC ..... 211/85.12; 206/77.1; D6/536, 540
See application file for complete search history.

(56) References Cited

U.S. PATENT DOCUMENTS 1,560,871 A * 11/1925 Smith ..... A47K 5/02 312/351
2,504,536 A * 4/1950 Kisselburg ..... A47K 5/02 131/231
2,842,893 A * 7/1958 Howerton ..... A47K 5/02 206/77.1
2,879,622 A * 3/1959 Graziano ..... A47K 5/02 206/77.1
3,019,549 A * 2/1962 Evans ..... A47K 5/02 206/77.1
3,054,211 A * 9/1962 Hawk ..... A47K 5/02 206/77.1
4,133,443 A * 1/1979 Medina ..... A47K 5/02 206/77.1
4,313,537 A * 2/1982 Collet ..... A47K 5/05 206/77.1
4,331,232 A * 5/1982 Larkin ..... A47K 5/03 206/565
4,392,630 A * 7/1983 Moontasir ..... A47K 5/02 248/316.8
4,435,030 A * 3/1984 Haven ..... A47K 5/08 206/77.1
4,630,794 A * 12/1986 Ross ..... A47K 5/08 206/77.1
5,509,529 A * 4/1996 Kelley ..... A47K 5/02 206/77.1

* cited by examiner

*Primary Examiner* — Alfred J Wujciak
(74) *Attorney, Agent, or Firm* — Li & Cai Intellectual Property (USA) Office

(57) ABSTRACT

A soap holder comprises a main body, and a carrying plate. The main body has a plurality of holes, an upper surface and a lower surface. The carrying plate has a plurality of bumps. The carrying plate is connected to one side of the main body by a hinge joint. Each of the plurality of bumps has a tip, and each of the plurality of bumps partially passes through a corresponding hole of the plurality of holes so the tips of the plurality of bumps expose above the upper surface. The tips of the plurality of bumps can carry a bar of soap. The main body and the carrying plate are separable and the soap drops onto the upper surface of the main body as each of the plurality of bumps withdraws from the corresponding hole of the plurality of holes.

5 Claims, 18 Drawing Sheets

SOAP HOLDER

BACKGROUND OF THE INVENTION

1. Field of the Invention

The present invention relates to a soap holder; in particular, to a soap holder which keeps the soap dry and handy to pick up.

2. Description of Related Art

Conventional soap holders often make the soap sticky and inconvenient to pick up. The remains of soap sticking onto the soap holder are also difficult to recycle and are therefore wasted.

SUMMARY OF THE INVENTION

The object of the present invention is to avoid soap sticking onto a soap holder commonly seen in conventional soap holders.

In order to achieve the aforementioned objects, according to an embodiment of the present invention, a soap holder comprises a main body and a carrying plate. The main body comprises a plurality of holes, an upper surface and a lower surface. The carrying plate comprises a plurality of bumps. The carrying plate is connected to one side of the main body by a hinge joint and is locked to another side of the main body opposite to the hinge joint by a releasable retaining structure. Each of the plurality of bumps has a tip. Each of the plurality of bumps partially passes through a corresponding hole of the plurality of holes so the tip of each of the plurality of bumps exposes above the upper surface and the tips of the plurality of bumps can carry a bar of soap when the main body and the carrying plate are locked together by the releasable retaining structure. The main body and the carrying plate are separable by releasing the releasable retaining structure and the soap drops onto the upper surface of the main body as each of the plurality of bumps withdraws from the corresponding hole of the plurality of holes.

In order to achieve the aforementioned objects, according to another embodiment of the present invention, a soap holder comprises a main body, a carrying plate and a linkage mechanism. The main body comprises a plurality of holes, an upper surface and a lower surface. The carrying plate comprises a plurality of bumps. The carrying plate is connected to one side of the main body. Each of the plurality of bumps has a tip. Each of the plurality of bumps partially passes through a corresponding hole of the plurality of holes so the tip of each of plurality of bumps exposes above the upper surface, and the tips of the plurality of bumps can carry a bar of soap. The linkage mechanism fixes the main body and the carrying plate on a plane. The linkage mechanism makes the main body and the carrying plate separable so each of the plurality of bumps withdraws from the corresponding hole of the plurality of holes and the tip of each of the plurality of bumps does not expose above the upper surface. The main body and the carrying plate are separable and the soap drops onto the upper surface of the main body as each of the plurality of bumps withdraws from the corresponding hole of the plurality of holes. The linkage mechanism comprises a linkage module and a fixation module. The linkage module, the main body, the carrying plate and the fixation module are hinged together. Each of the plurality of bumps withdraws from the corresponding hole of the plurality of holes and the tip of each of the plurality of bumps does not expose above the upper surface when an external force is applied over the linkage module. The fixation module is fixed on the plane. The linkage module further comprises a linkage and a guiding module. The linkage connects the carrying plate and the fixation module. The guiding module is disposed on a surface of the carrying plate opposite to the plurality of bumps and the guiding module has a slideway. The fixation module comprises a fixation and a supporting arm. The fixation module is fixed on the plane. An end portion of the supporting arm is connected to the guiding module and sliding along the slideway. The end portion of the supporting arm slides along the slideway and makes the main body rotate about the carrying plate when an external force is applied over the linkage and makes the linkage rotate away from the fixation, so each of the plurality of bumps withdraws from the corresponding hole of the plurality of holes and the tip of each of the plurality of bumps does not expose above the upper surface.

The present invention has the advantage that a bar of soap is placed on the tips of the plurality of bumps of the carrying plate, the soap separates from the tips of the plurality of bumps of the carrying plate and drops onto the upper surface of the main body as a user separates the carrying plate from the main body.

DETAILED DESCRIPTION OF THE PREFERRED EMBODIMENTS

Figure 1:
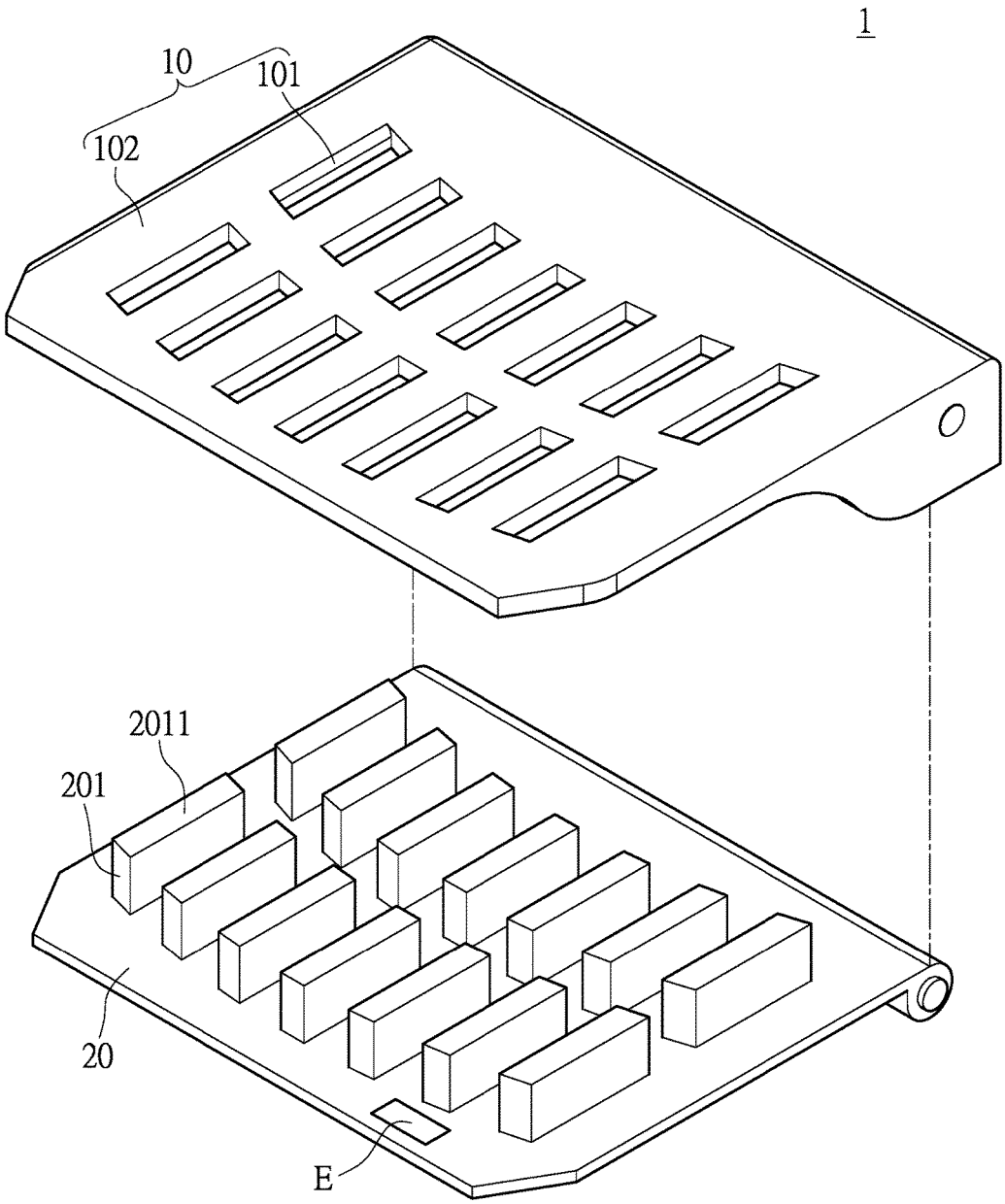
FIG. 1 shows an exploded view of a soap holder according to a first embodiment of the present invention.

Refer to FIGS. 1 to 4 that show a soap holder according to a first embodiment of the present invention. In FIG. 1, the soap holder 1 comprises a main body 10 and a carrying plate 20. The main body 10 comprises a plurality of holes 101, an upper surface 102 and a lower surface 103 (see FIGS. 4). The carrying plate 20 comprises a plurality of bumps 201 and connects to one side of the main body 10. Each of the plurality of bumps 201 can partially pass through a corresponding hole of the plurality of holes 101. That is, the position of the plurality of bumps 201 corresponds to the position of the plurality of holes 101, and the cross-sectional area of each of the plurality of bumps 201 is smaller than the cross-sectional area of each of the plurality of holes 101. The present invention does not intend to limit the shape, arrangement and number of the plurality of holes 101 and plurality of bumps 201 as long as the plurality of bumps 201 can pass through the plurality of holes 101.

Figure 2:
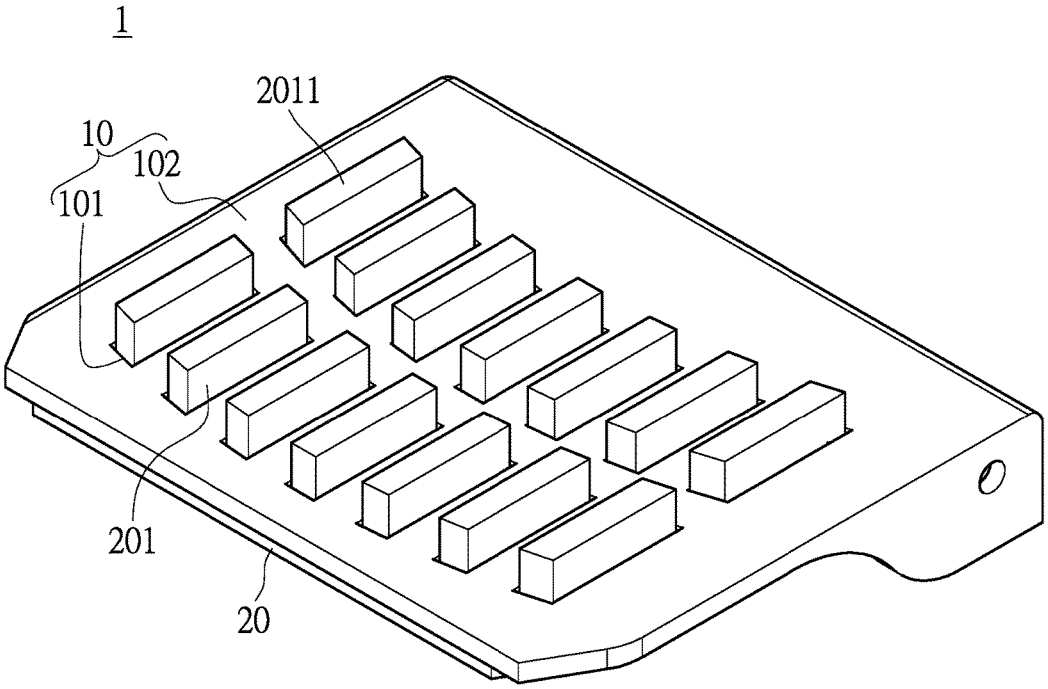
FIG. 2 shows a perspective view of a soap holder according to the first embodiment of the present invention.

Refer to FIG. 2, one side of the main body 10 and one side of the carrying plate 20 can be connected by a hinge joint. When the main body 10 and the carrying plate 20 are locked together, each of the plurality of bumps 201 partially passes through the corresponding hole of the plurality of holes 101. Each of the plurality of bumps 201 has a tip 2011 that exposes above the upper surface 102 when the main body 10 and the carrying plate 20 are locked together. The exposed tips 2011 can carry a bar of soap S. Please note the tips 2011 of the plurality of bumps 201 extend beyond the upper surface 102 of the main body 10 rather than level therewith when the main body 10 and the carrying plate 20 are locked together. Therefore, the soap S does not contact the upper surface 102 of the main body 10 when it is placed on the tips 2011 of the plurality of bumps 201.

Please note the tips 2011 are approximately level to carry the soap S stably when exposed above the upper surface 102 of the main body 10. It is also possible that the tips 2011 of the plurality of bumps 201 jointly form a curved surface rather than a level surface, to carry the soap S.

In addition, the side of the main body 10 and carrying plate 20 opposite to the hinge joint can be locked by a releasable retaining structure (not shown in drawings). That is, the main body 10 and the carrying plate 20 further comprise corresponding mortise and latch respectively (not shown in drawings) so the main body 10 and the carrying plate 20 are locked together. For example, the main body 10 includes at least one mortise (not shown in drawings) and the carrying plate 20 includes at least one latch (not shown in drawings). The main body 10 and the carrying plate 20 are locked together by matching the at least one mortise and latch. When picking up the soap S, the user separates the main body 10 and the carrying plate 20 by releasing the at least one mortise and latch so the tips 2011 of the plurality of bumps 201 do not expose above the upper surface 102 of the main body 10.

Figure 3A:
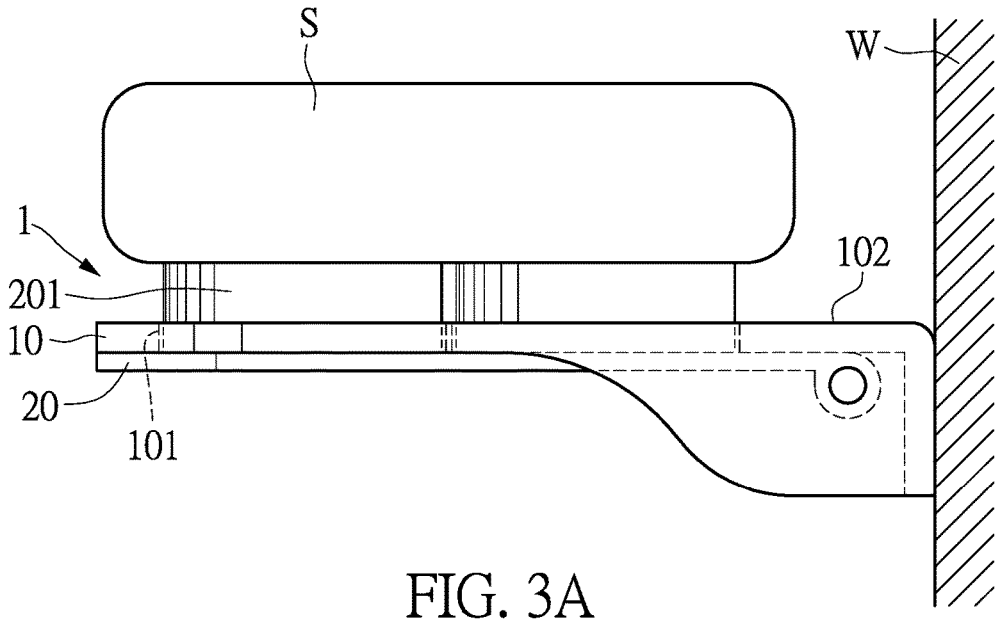
FIGS. 3A and 3B are lateral views of a soap holder according to the first embodiment of the present invention.
Figure 3B:
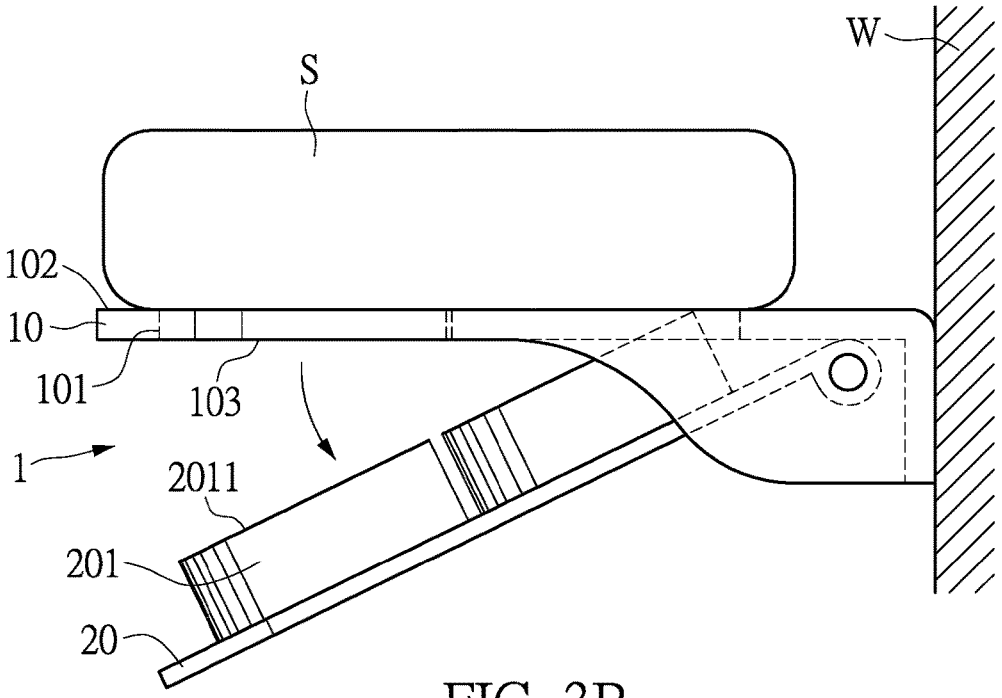

Referring to FIGS. 3A and 3B, in the first embodiment of the present invention, one side of the main body 10 is fixed on a wall W. The main body 10 and the carrying plate 20 are locked together by the at least one mortise and latch (not shown in drawings). Referring to FIG. 3A, the soap S is placed on the tips 2011 of the plurality of bumps 201 that expose above the upper surface 102 of the main body 10 (see FIG. 2) when the main body 10 and the carrying plate 20 are locked together. Referring to FIG. 3B, the plurality of bumps 201 withdraws from the plurality of holes 101 and the soap S drops onto the upper surface 102 of the main body 10 when the user separates the main body 10 and the carrying plate 20 by releasing the at least one mortise and latch (i.e., rotates the carrying plate 20 counterclockwise in respect to the main body 10). Therefore, the soap S does not stick onto the main body 10 when it is picked up by the user.

In another embodiment, the upper surface 102 of the main body 10 is inclined. The soap S separates from the plurality of bumps 201, drops onto the main body 10 and slides toward the user along the inclined upper surface 102 when the user rotates the carrying plate 20 in respect to the main body 10.

As described above, the user relocks the main body 10 and the carrying plate 20 by matching the at least one mortise and latch (not shown in drawings) so the tips 2011 of the plurality of bumps 201 again expose above the upper surface 102 of the main body 10. Therefore the soap S is placed on the tips 2011 of the plurality of bumps 201 again when the user returns the soap S.

Preferably, an elastic unit (not shown in drawings), for example a spring, is disposed between the main body 10 and the carrying plate 20. The elastic unit is elongated when the user rotates the carrying plate 20 in respect to the main body 10. Therefore, the elastic unit restores the position of the carrying plate 20 when the user picks up the soap S and releases the carrying plate 20. It is also possible to dispose the elastic unit between the carrying plate 20 and the wall W, or between the main body 10 and the wall W. Therefore, the elastic unit is under tension when the carrying plate 20 rotates in respect to the main body 10.

Please note the main body 10 and the carrying plate 20 are connected by a hinge joint in this first embodiment. The present invention, however, does not intend to limit the type of connection between the main body 10 and the carrying plate 20 as long as the main body 10 and the carrying plate 20 can be switched between a locked position (i.e., the tips 2011 of the plurality of bumps 201 expose above the upper surface 102) and a separated position (i.e., the tips 2011 of the plurality of bumps 201 do not expose above the upper surface 102).

Figure 4:
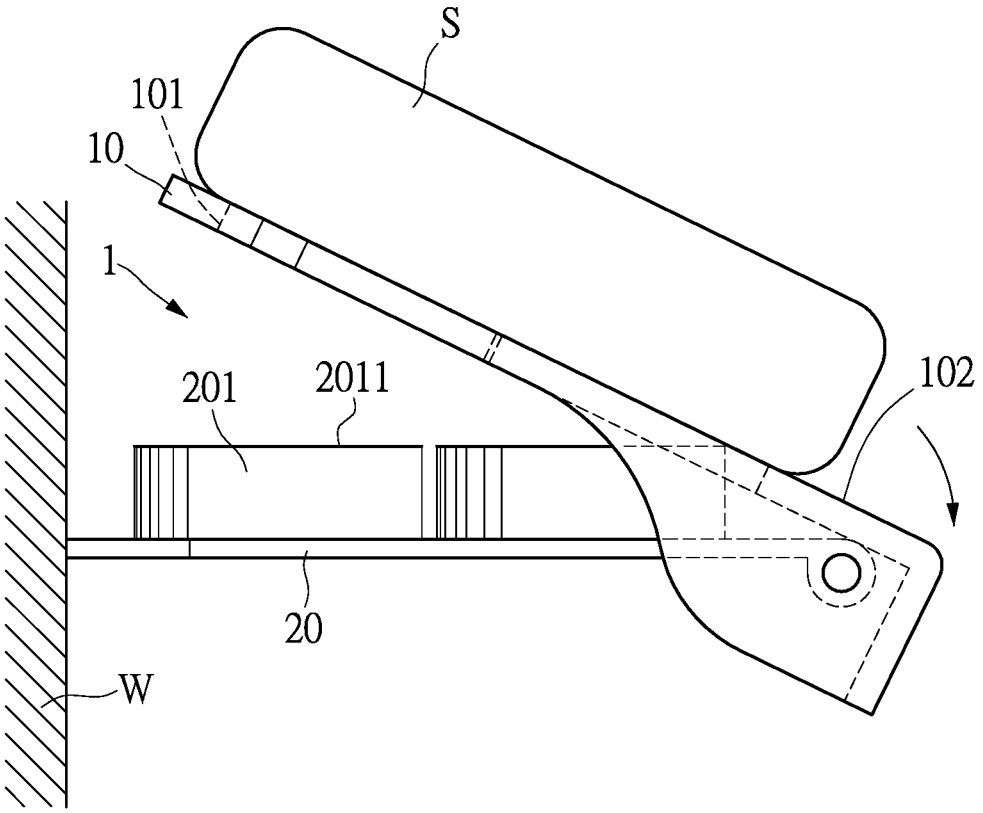
FIG. 4 is a lateral view of a soap holder according to a second embodiment of the present invention.

Refer to FIG. 4 that shows a soap holder according to a second embodiment of the present invention. The elements in this second embodiment are the same as the first embodiment except their arrangement is different. Specifically, one side of the carry plate 20 is fixed on the wall W and the other side of the carry plate 20 is connected to the main body 10 by a hinge joint. That is, the hinge joint connecting the main body 10 and the carrying plate 20 is located away from the wall W. Therefore, the plurality of bumps 201 withdraw from the plurality of holes 101 and the tips 2011 of the plurality of bumps 201 do not expose above the upper surface 102 by compressing the main body 10 at the side where the hinge joint is located. Therefore, the soap S slides toward the user along the inclined upper surface 102.

Figure 5A:
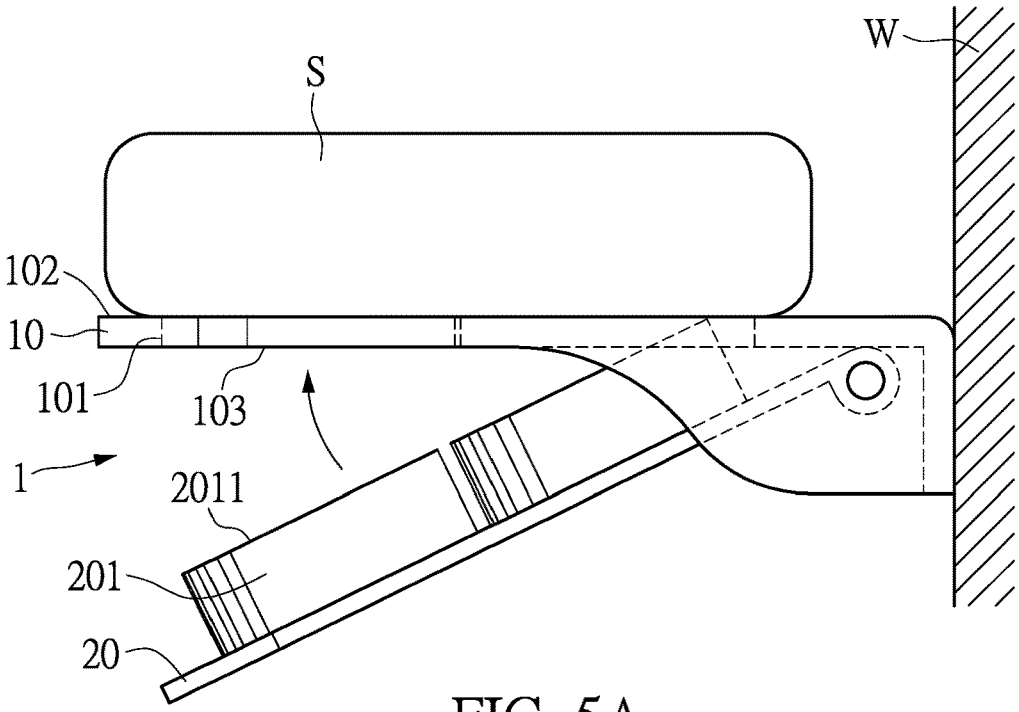
FIGS. 5A and 5B are lateral views of a soap holder according to a third embodiment of the present invention.
Figure 5B:
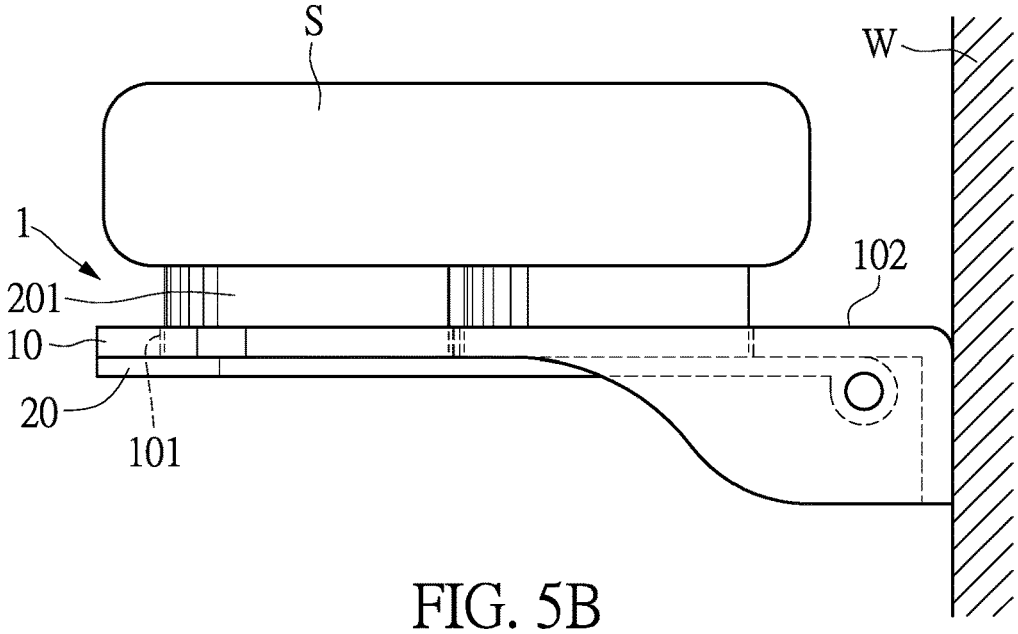

Refer to FIGS. 5A and 5B that show a soap holder according to a third embodiment of the present invention. The elements in this third embodiment are the same as the first and second embodiments except their arrangement is different. In this embodiment, the soap S is placed on the upper surface 102 of the main body 10. The plurality of bumps 201 of the carrying plate 20 do not pass through the plurality of holes 101. When the user rotates the carrying plate 20 toward the main body 10 and makes the plurality of bumps 201 pass through the plurality of holes 101, the tips 2011 of the plurality of bumps 201 lift the soap S from the upper surface 102 of the main body 10. Therefore, the soap S will not stick onto the main body 10 and the user can easily pick up the soap S placed on the tips 2011 of the plurality of bumps 201.

Figure 6:
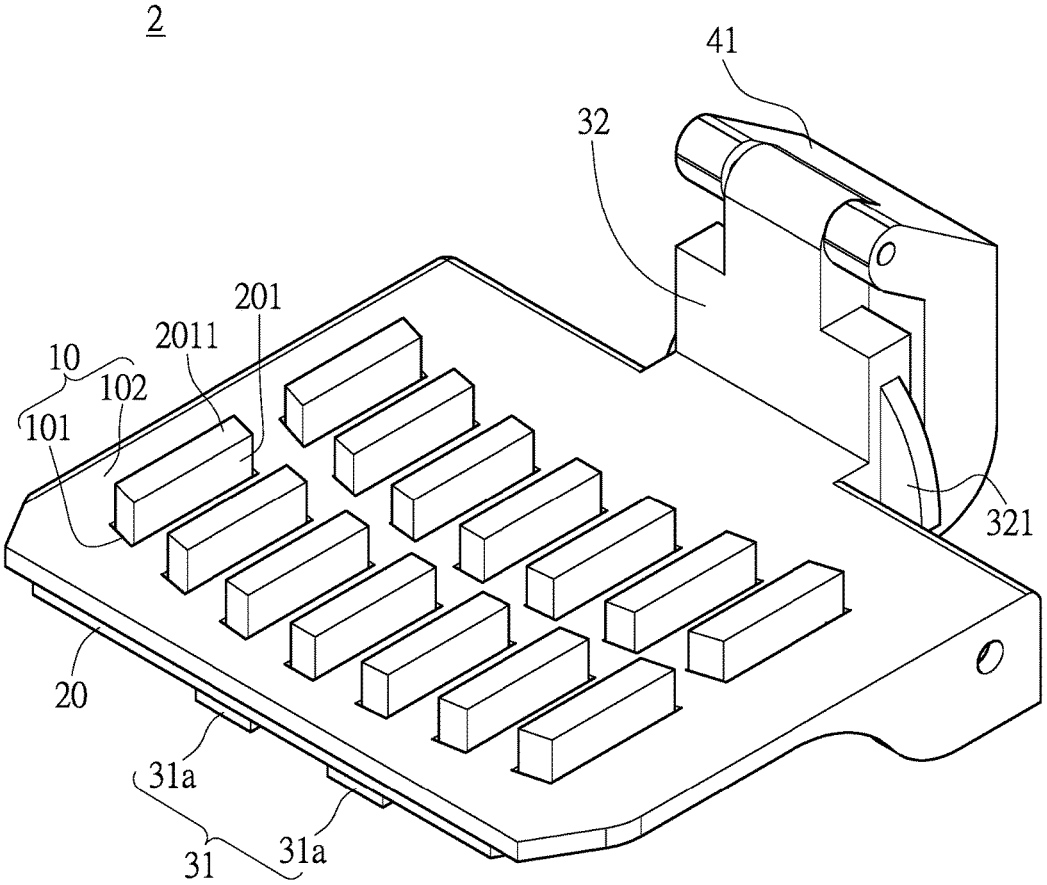
FIG. 6 shows a perspective view of a soap holder according to a fourth embodiment of the present invention.
Figure 7:
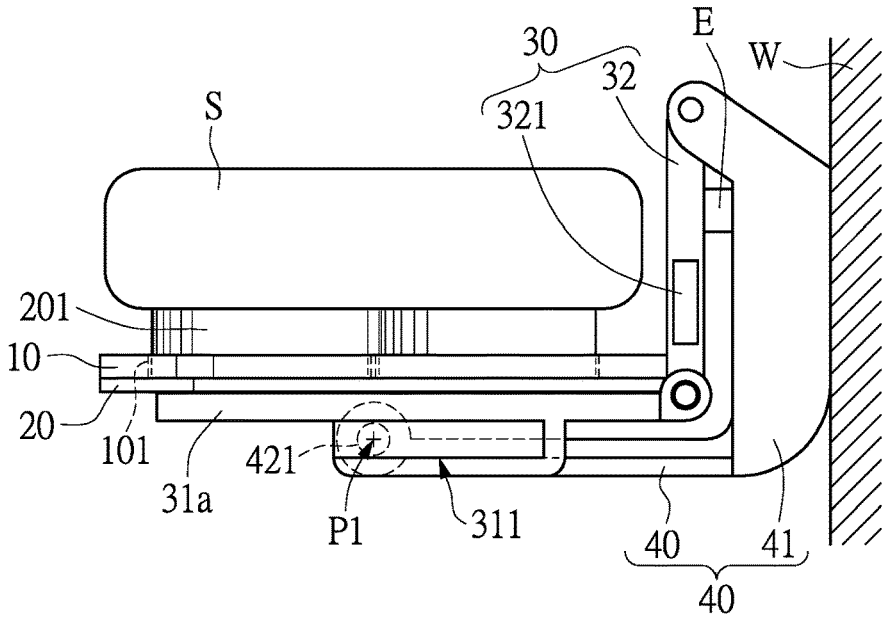
FIGS. 7 and 8 are lateral views of a soap holder according to the fourth embodiment of the present invention.
Figure 8:
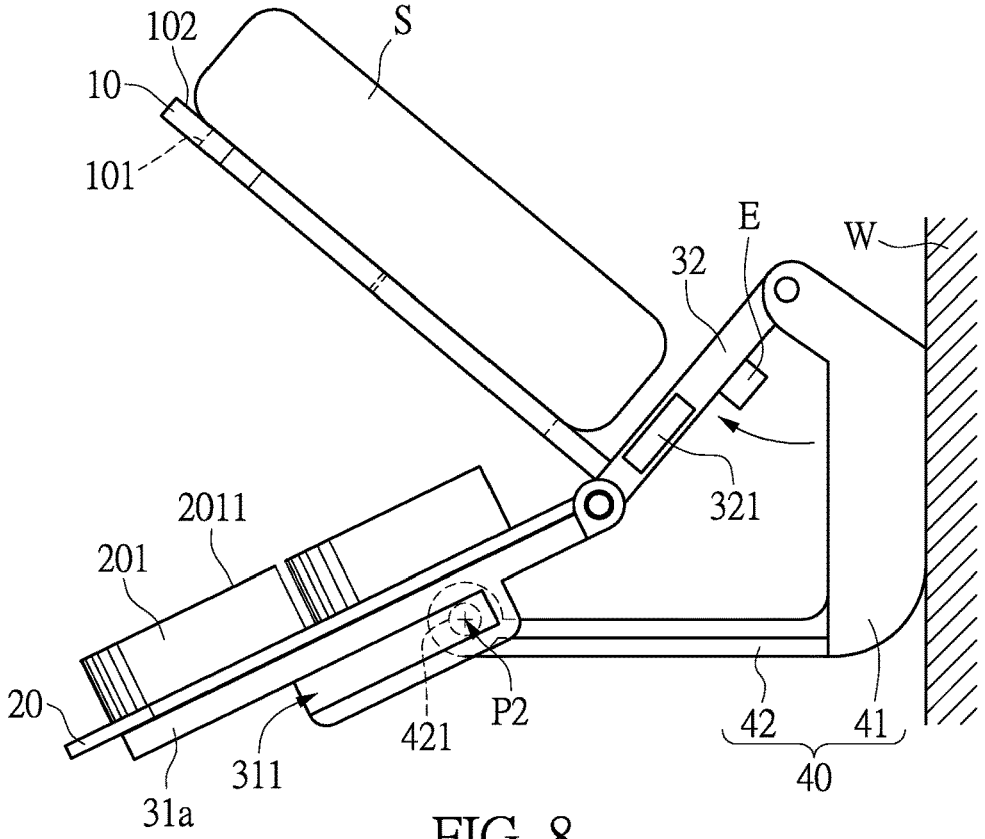

Refer to FIGS. 6 to 8 that show a soap holder according to a fourth embodiment of the present invention. The soap holder 2 comprises a main body 10, a carrying plate 20 and a linkage mechanism. The configurations of the main body 10 and the carrying plate 20 are the same as previous embodiments. The main difference between this embodiment and previous ones is the soap holder 2 further comprises a linkage mechanism, which comprises a linkage module 30 and a fixation module 40. The linkage module 30 comprises a guiding module 31 and a linkage 32. The main body 10 and the linkage 32 are separable. The fixation module 40 fixes the soap holder 2 on a plane (e.g., a wall Win the drawings), and comprises a fixation 41 and a supporting arm 42.

The guiding module 31 is disposed on a surface of the carrying plate 20 opposite to the plurality of bumps 201. That is, the plurality of bumps 201 are disposed on one surface of the carrying plate 20, and the guiding module 31 is disposed on the opposite surface. The guiding module 31 has a slideway 311. As shown in drawings, the guiding module 31 in this embodiment includes two guides 31*a*, each guide 31*a* is independent from the other. The guides 31*a* are disposed with an interval, and the guides 31*a* together form the slideway 311.

The bilateral ends of the linkage 32 connect to the carrying plate 20 and the fixation 41 respectively by hinge joints. Therefore, the carrying plate 20 moves with the linkage 32 when an external force is applied. In other embodiments, the linkage 32 can connect to the fixation 41 indirectly via other elements.

The fixation 41 connects the wall W and the linkage 32. The linkage 32 connects to the carrying plate 20. Specifically, the linkage 32 connects the fixation 41 and the carrying plate 20 by hinge joints. The supporting arm 42 is disposed on the surface of the fixation 41 opposite to the wall W. The supporting arm 42 is substantially L-shaped, and the supporting arm 42 and the fixation 41 can be integrally formed. An end portion 421 of the supporting arm 42 connects to the guiding module 31 and slides along the slideway 311, thus the supporting arm 42 limits the range of rotation of the carrying plate 20. The supporting arm 42 also supports the main body 10, the carrying plate 20 and the soap S.

Referring to FIG. 7, the end portion 421 of the supporting arm 42 is in a first position P1 relative to the slideway 311 and the linkage 32 is close to (and in parallel with) the fixation 41 when the plurality of bumps 201 pass through the plurality of holes 101 and the tips 2011 of the plurality of bumps 201 expose above the upper surface 102. In this case, the main body 10 and the carrying plate 20 are substantially level so the soap S is stably placed on the tips 2011 of the plurality of bumps 201. In practice, the soap holder can maintain the status shown in FIG. 7 even without the soap S by properly designing the weight of the main body 10 and carrying plate 20, as well as the length of the linkage 32 and the supporting arm 42.

Referring to FIG. 8, the linkage 32 rotates away from the fixation 41 (i.e., clockwise rotation in FIG. 8) when an external force is applied over the linkage 32. In this case, the linkage 32 makes the main body 10 and the carrying plate 20 rotate in opposite directions (i.e. the main body 10 in clockwise rotation and the carrying plate 20 in counterclockwise rotation in FIG. 8) and separate from each other. The end portion 421 of the supporting arm 42 shifts to a second position P2 relative to the slideway 311. The carrying plate 20 separates from the main body 10 and is inclined. Therefore, the soap S is lifted from the tips 2011 of the plurality of bumps 201 and drops onto the upper surface 102 of the main body 10.

In other embodiments, the main body 10 does not connect to the linkage 32. That is, when an external force is applied over the linkage 32, the linkage 32 makes the carrying plate 32, but not the main body 10, rotate. In this case, the main body 10 and the carrying plate 20 are separated singly because the linkage 32 makes the supporting arm 42 slide along the slideway 311.

Referring to FIG. 6 again, preferably, a pair of handles 321 are disposed bilaterally on the linkage 32, thus the user moves the linkage 32 easily.

Figure 9:
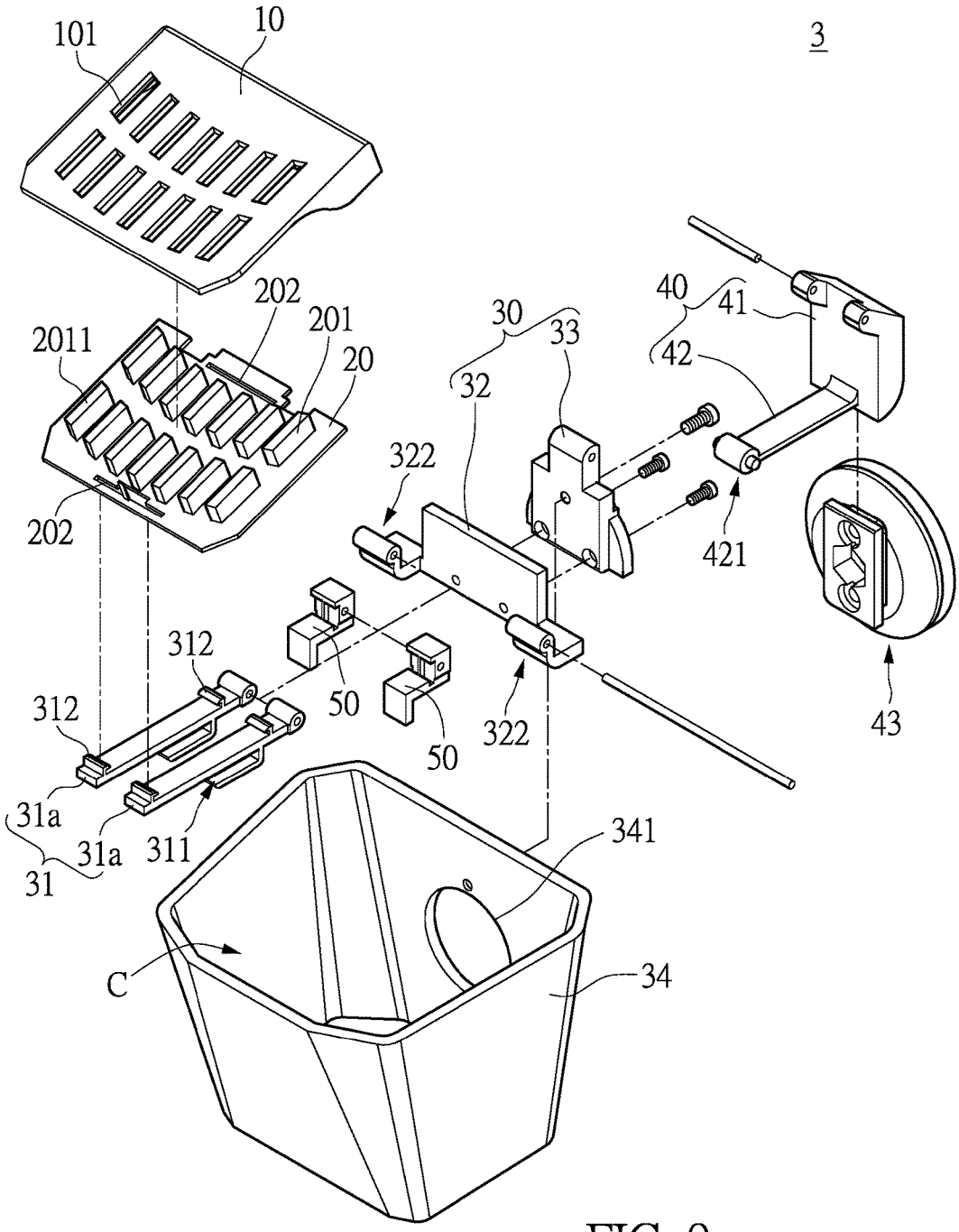
FIGS. 9 and 10 are exploded views of a soap holder according to a fifth embodiment of the present invention.
Figure 10:
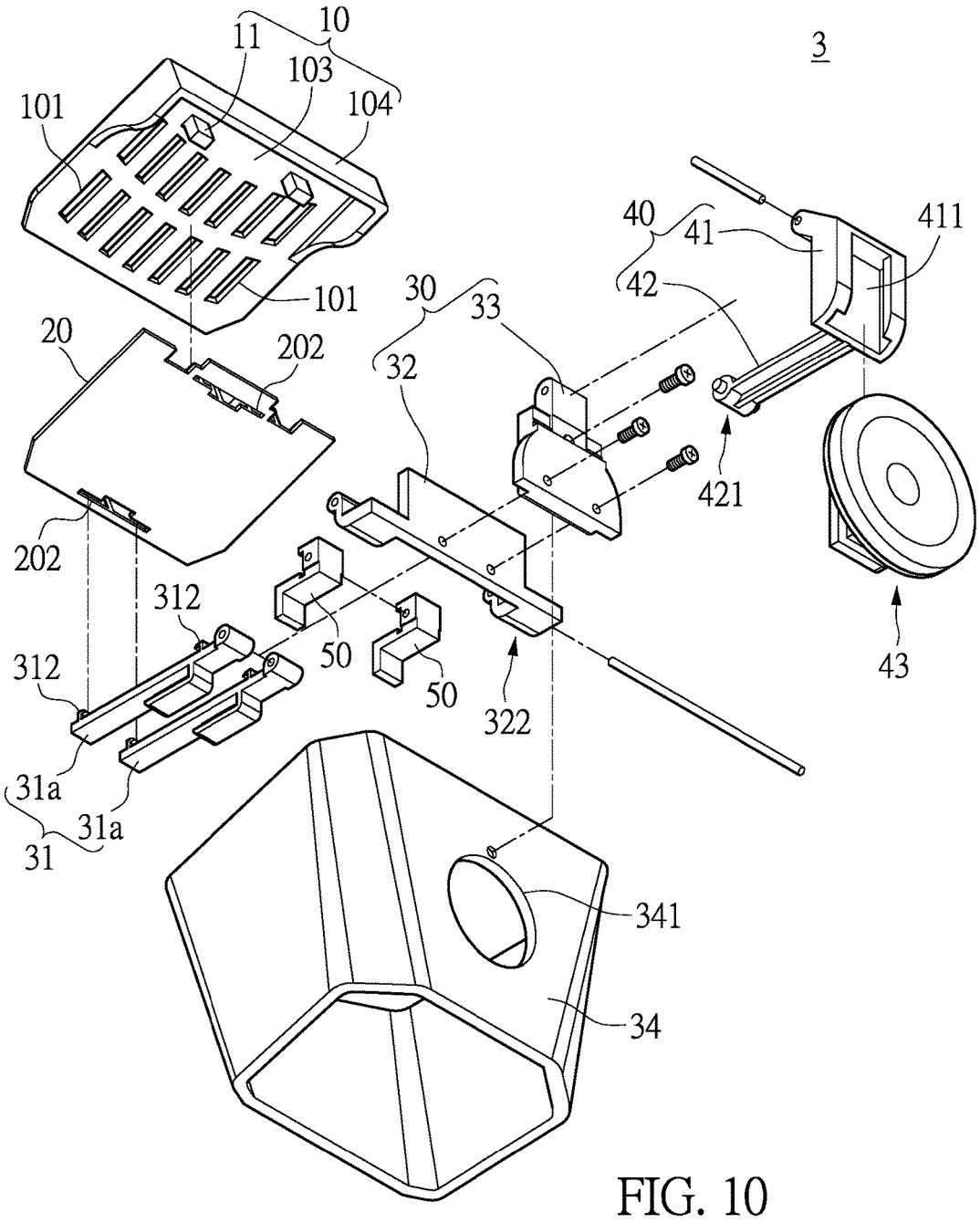

Refer to FIGS. 9 to 17 that show a soap holder according to a fifth embodiment of the present invention. Referring to FIGS. 9 and 10, the soap holder 3 comprises a main body 10, a carrying plate 20 and a linkage mechanism. The linkage mechanism comprises a linkage module 30, a fixation module 40 and two molded supports 50. The configurations of the main body 10 and the carrying plate 20 are the same as previous embodiments. The molded supports 50 limit the range of separation between the main body 10 and the carrying plate 20.

The linkage module 30 comprises a guiding module 31, a linkage 32, an assistive linkage 33 and a container 34. The guiding module 31 comprises two guides 31*a*, and each guide 31*a* has a slideway 311 and a hook 312. The carrying plate 20 also comprises two trenches 202 corresponding to the hooks 312 of the guides 31*a*. Therefore, the guides 31*a* connect to the surface of the carrying plate 20 opposite to the plurality of bumps 201 by the trenches 202 of the carrying plate 20.

The linkage 32 comprises two hinges 322. The two hinges 322, the two guides 31*a* and the two molded supports 50 are hinged together (see FIG. 12). The two guides 31*a*, the carrying plate 20 and the two molded supports 50 all can rotate about the linkage 32. The assistive linkage 33 makes the linkage 32 and the carrying plate 20 connected to the interior surface of the container 34. Specifically, the linkage 32 and the carrying plate 20 are disposed in a space C of the container 34. One side of the linkage 34 connects to the carrying plate 20 and the other side of the linkage 34 connects to the interior surface of the container 34. The assistive linkage 33 is disposed on the exterior surface of the container 34 corresponding to the linkage 32. The linkage 32, the assistive linkage 33 and the container 34 are connected via an applicable fixation means.

The fixation module 40 comprises a fixation 41, a supporting arm 42 and an assistive fixation 43. The assistive fixation 43 connects the fixation 41 and the wall W (see FIG. 14). Specifically, the assistive fixation 43 is fixed on the wall W, and connected to the assistive fixation 43 by a fixation groove 411 disposed on the fixation 41 (see FIGS. 14 and 15). Therefore the connection between the fixation 41 and the assistive fixation 43 is releasable. The fixation 41 further connects to the linkage 32 via the assistive linkage 33.

The supporting arm 42 stretches out perpendicularly from the fixation 41. The end portion 421 of the supporting arm 42 connects to the guiding module 31 and slides along the slideway 311. Specifically, the end portion 421 of the supporting arm 42 has two pins (not shown in drawings) to slide along the slideway 311 of the guide 31*a*. Please note the present invention does not intend to limit the type of connection between the guiding module 31 and the supporting arm 42 and can be modified according to practical needs.

Figure 11:
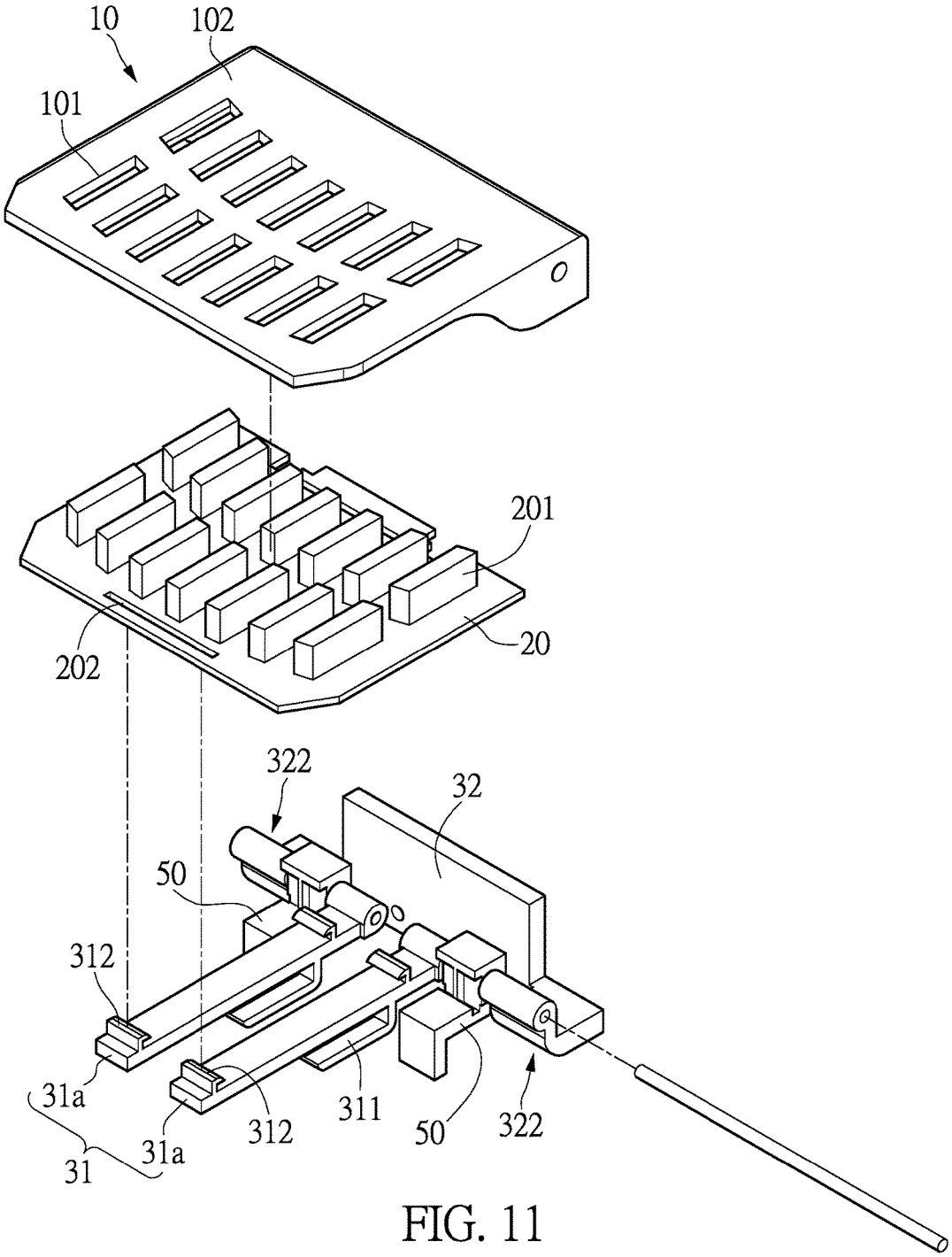
FIGS. 11 and 12 are partial exploded views of a soap holder according to the fifth embodiment of the present invention.
Figure 12:
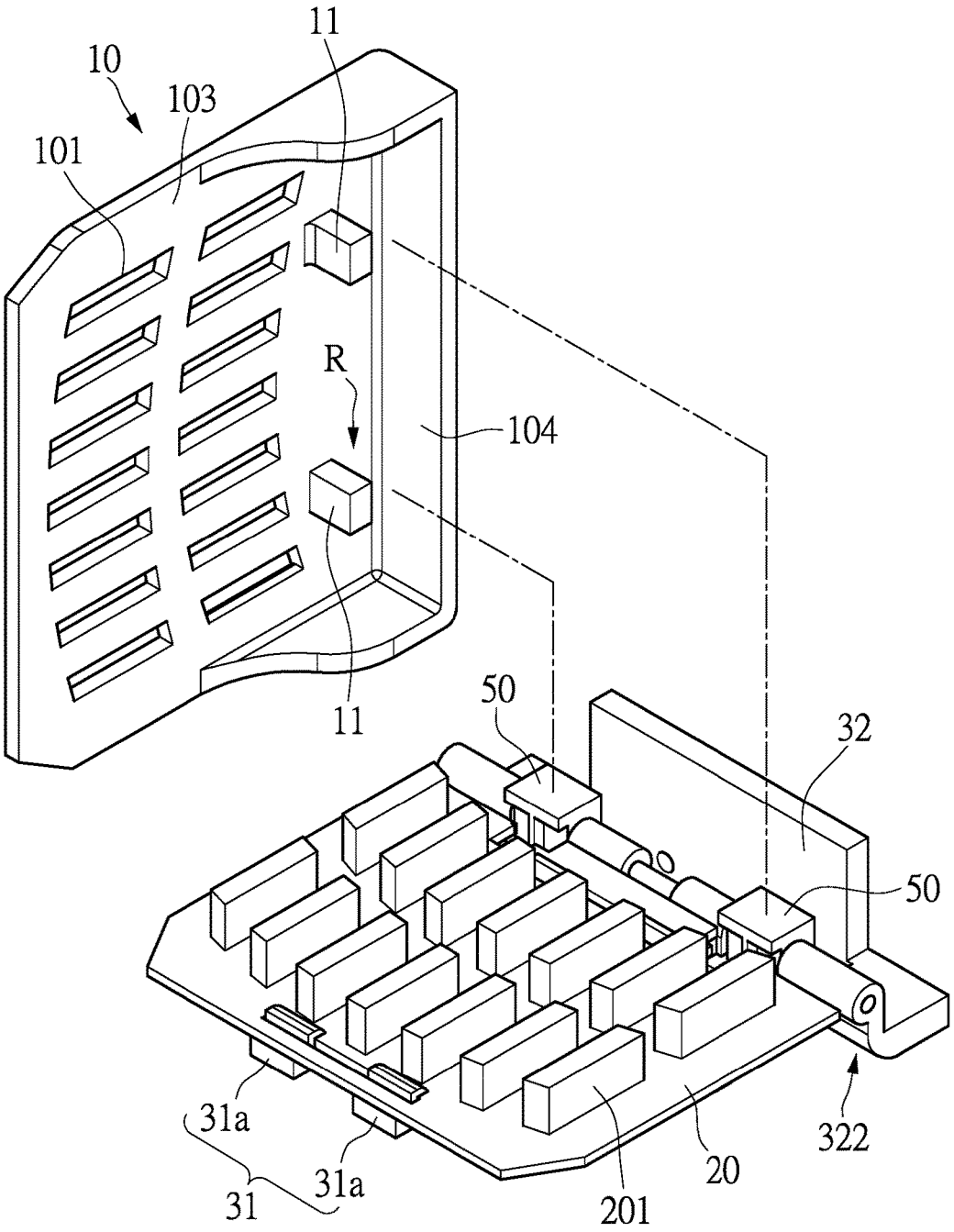

Referring to FIGS. 11 and 12, the two guides 31*a* and the two molded supports 50 are disposed between the two hinges 322 of the linkage 32. The two guides 31*a*, the two molded supports 50 and the linkage 32 are hinged together by the hinge rod (not marked in drawings). The two molded supports 50 are substantially N-shaped (see FIG. 9). Referring to FIG. 12, each of the molded supports 50 includes a head, which extends above the height of two hinges 322 when hinged together with the guides 31*a* and the linkage 32. The main body 10 further comprises two stops 11 and a sidewall 104. The two stops 11 are disposed over the lower surface 103 corresponding to the molded supports 50. The sidewall 104 is disposed on a side of the main body 10 near the two stops 11. The space between the two stops 11 and the sidewall 104 forms an interval R. The head of each of the molded supports 50 fits into the interval R.

Specifically, the main body 10 is locked with the two molded supports 50 by the interval R between the two stops 11 and the sidewall 104 so the main body 10 covers the surface of the carrying plate 20 having the plurality of bumps 201. In addition, the main body 10 can rotate in respect to the carrying plate because the two molded supports 50 can rotate in respect to the linkage 32 and the carrying plate 20. Therefore, the main body 10 and the carrying plate 20 are separable. In other applications, the main body 10 directly connects to the linkage 32, and the main body 10 and the molded supports 50 are locked by other elements. It is also possible that the main body 10 and the molded supports 50 are locked by other means.

Figure 13:
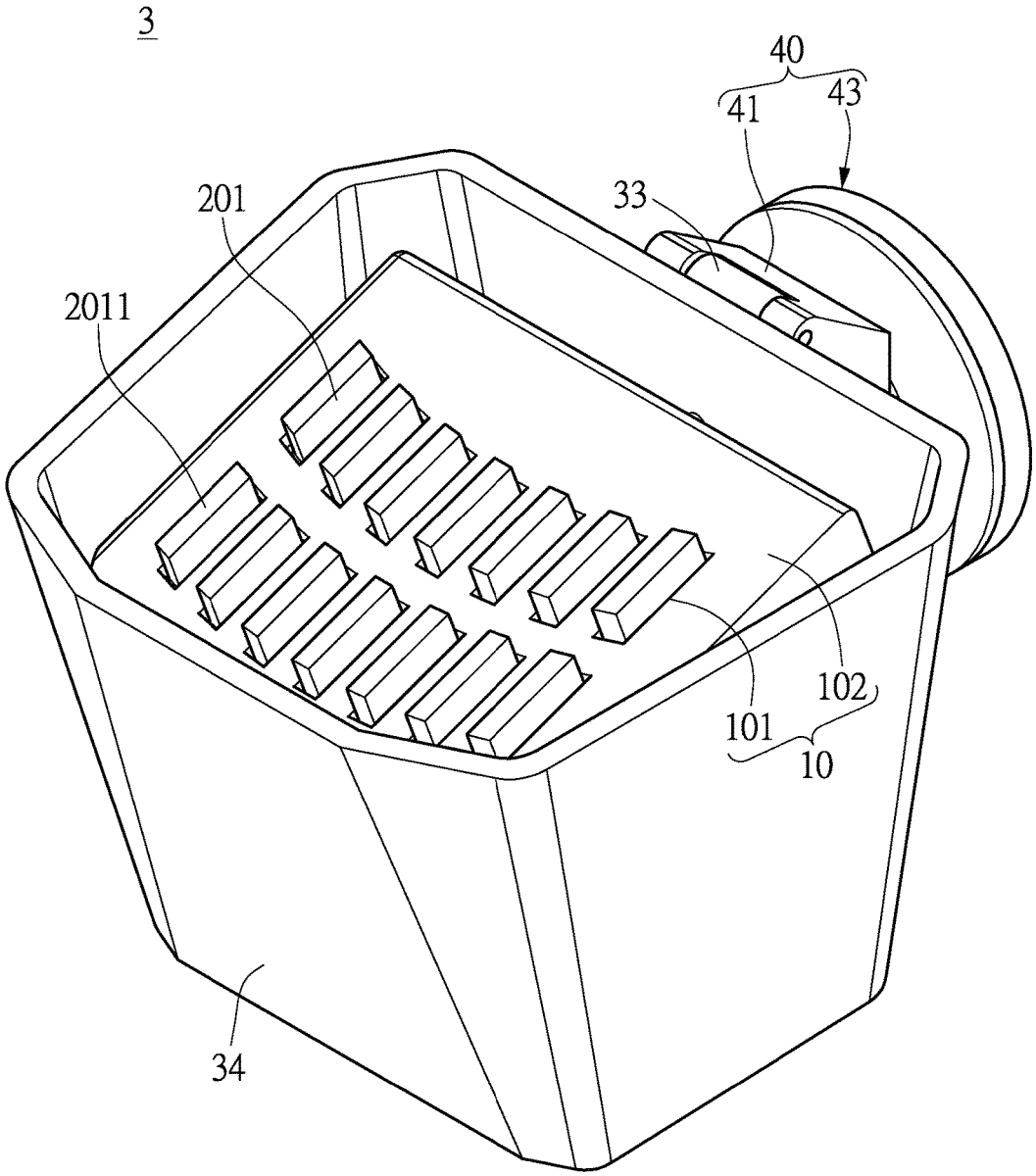
FIG. 13 shows a perspective view of a soap holder according to the fifth embodiment of the present invention.

Referring to FIG. 13, the container 34 houses the main body 10 and the carrying plate 20. The plurality of bumps 201 partially pass through the plurality of holes 101 so the tips 2011 of the plurality of bumps 201 expose above the upper surface 102. The bar of soap S is placed on the tips 2011 of the plurality of bumps 201.

Figure 14:
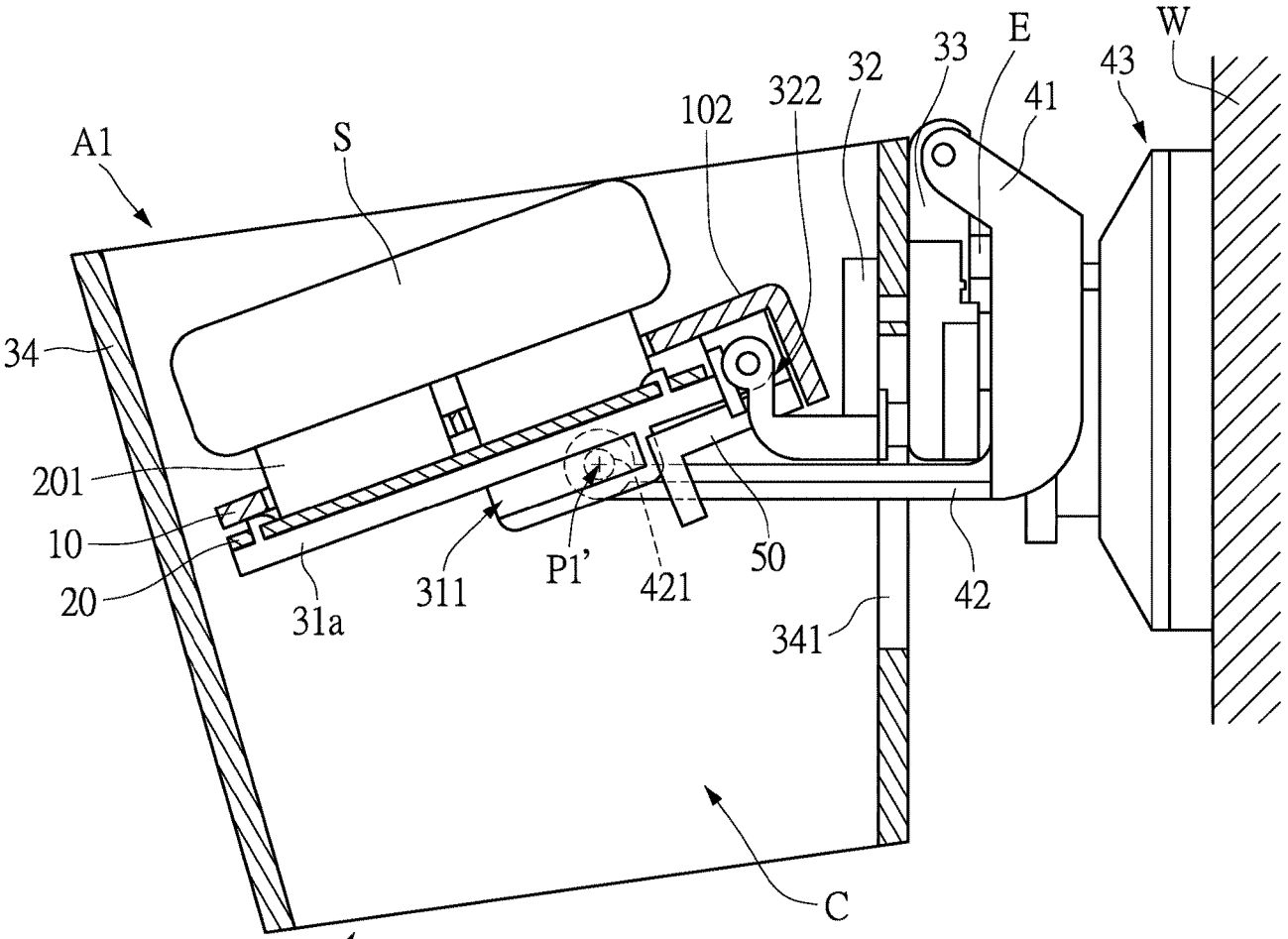
FIGS. 14 and 15 are lateral views of a soap holder according to the fifth embodiment of the present invention.

Referring to FIG. 14, the container 34 has an opening 341, which the supporting arm 42 passes through. The end portion 421 of the supporting arm 42 is in a first position P1' relative to the slideway 311. The main body 10 and the carrying plate 20 directly or indirectly connect to the linkage 32. The main body 10 and the carrying plate 20 are inclined in the container 34.

Figure 15:
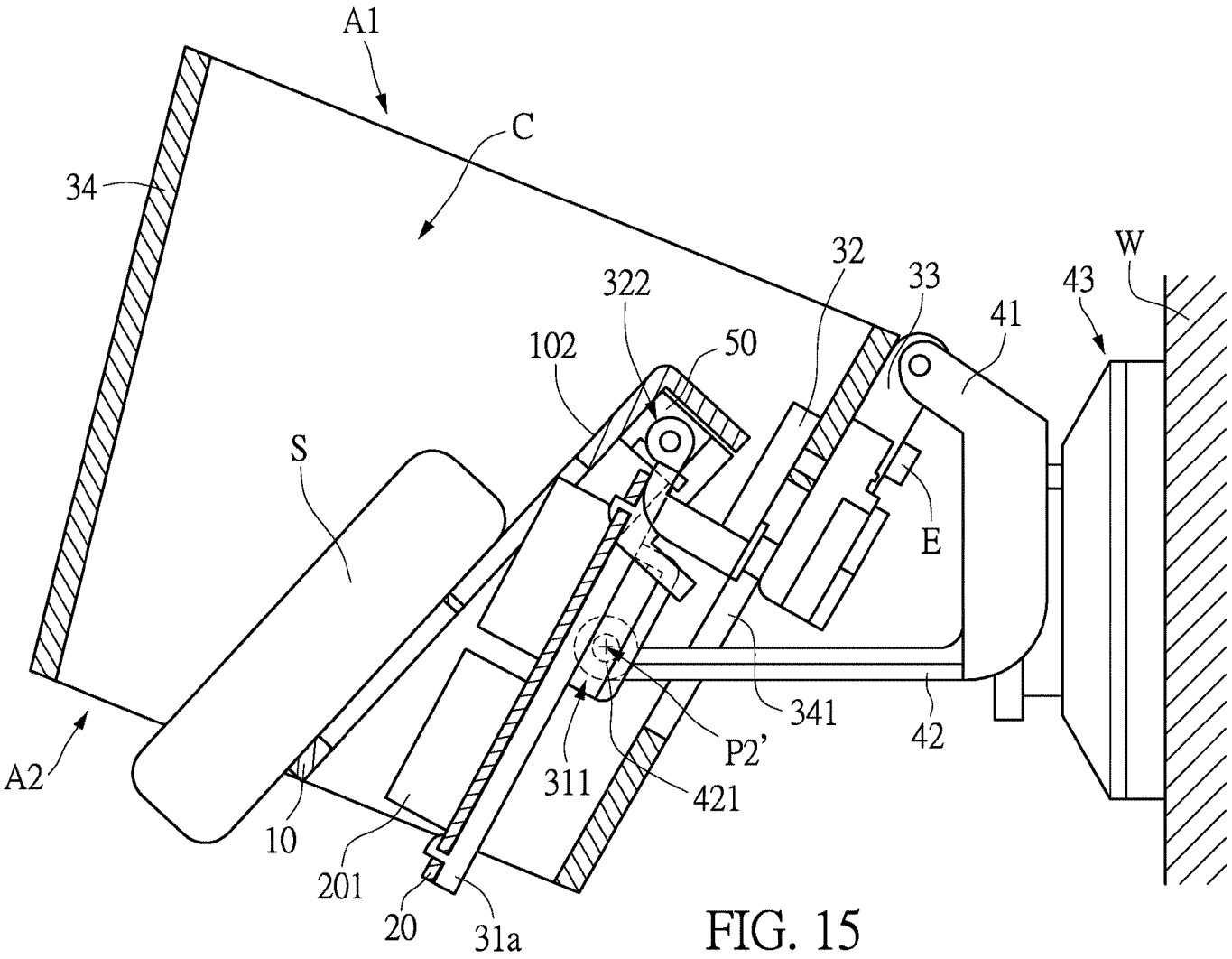
Figure 16:
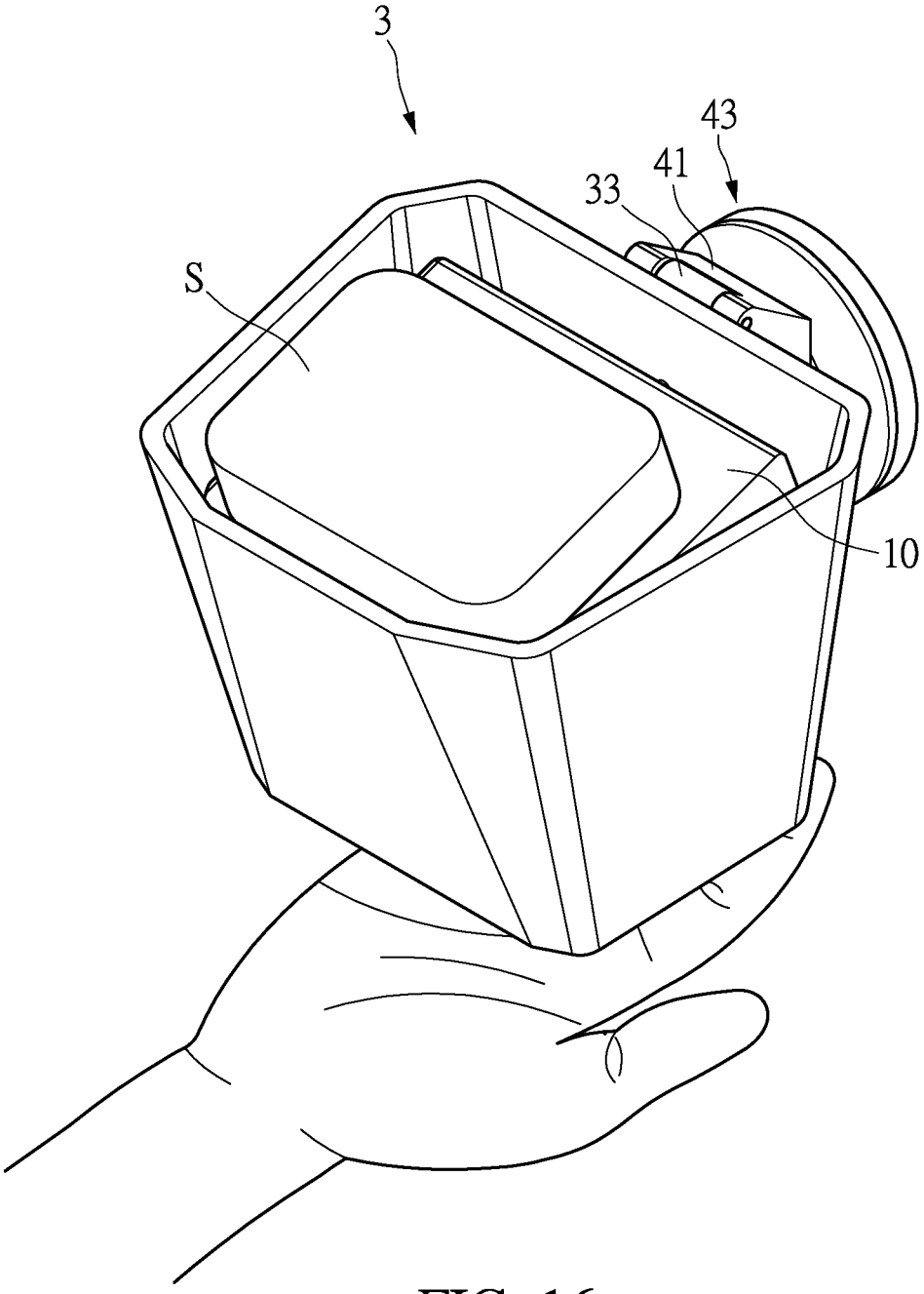
FIGS. 16 and 17 are perspective views of a soap holder according to the fifth embodiment of the present invention.
Figure 17:
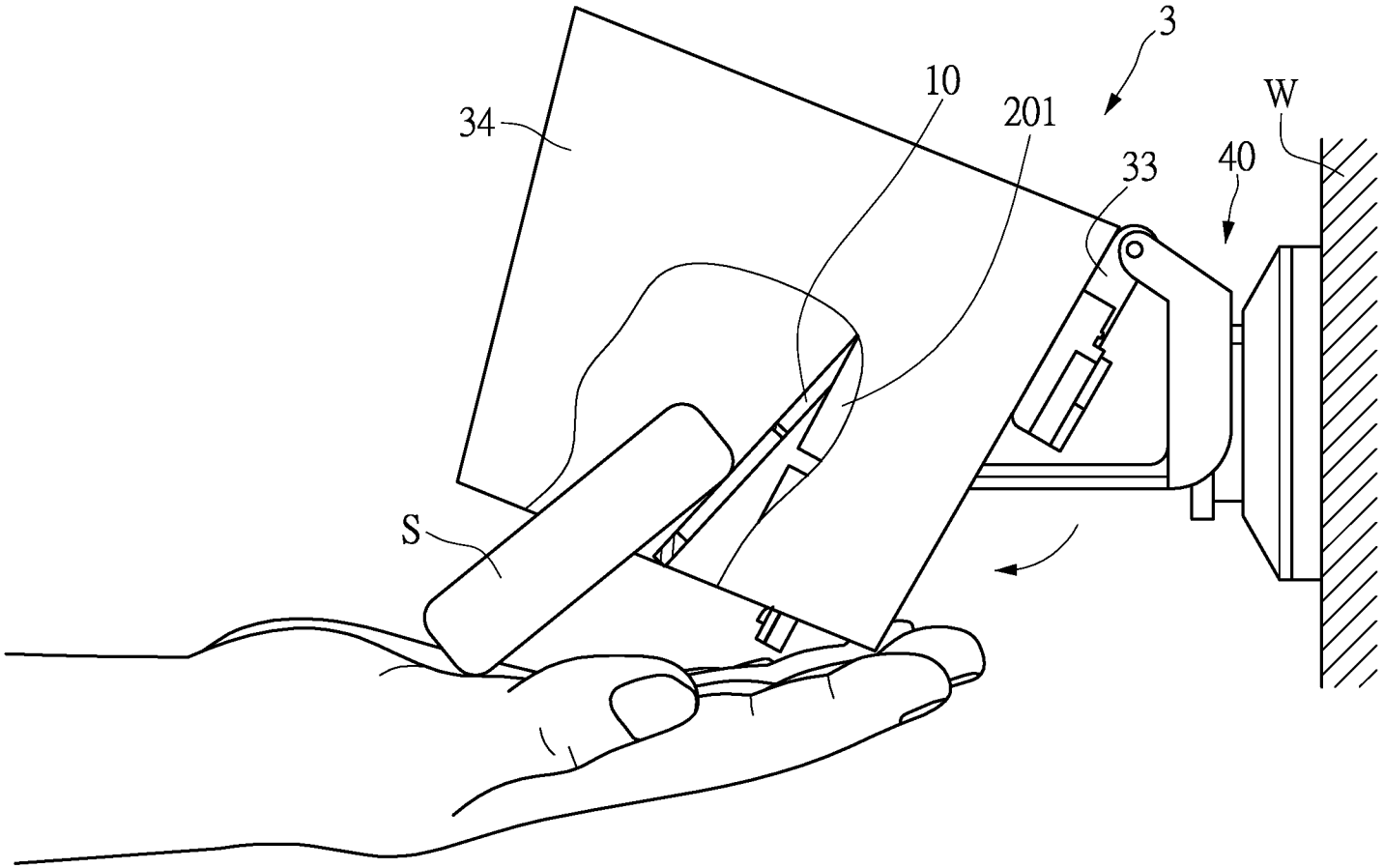

Referring to FIGS. 15 to 17, the user places his/her hand in the space between the container 34 and the wall W, and then pulls the container 34 to make the container 34 rotate away from the wall W (i.e., clockwise rotation in FIGS. 15 and 17). In this case, the hinge 322 of the linkage 32 changes its position according to the rotation of the container 34. Accordingly, the main body 10 and the carrying plate 20 rotate toward the wall W (i.e., counterclockwise rotation in FIGS. 15 and 17) due to their own weight. The main body 10 and the carrying plate 20 are separated and the tips 2011 of the plurality of bumps 201 do not expose above the upper surface 102 due to the molded supports 50. At the time, the end portion 421 of the supporting arm 42 shifts to a second position P2' relative to the slideway 311 (see FIG. 15). Therefore the soap S drops onto the upper surface 102 of the main body 10 and slides toward the user along the inclined upper surface 102.

Referring FIG. 15, after the soap S falls onto the hand of the user, the container 34 rotates back toward the wall W and returns to the initial position as shown in FIGS. 13 and 14 due to its own weight. Similarly, the main body 10 and the carrying plate 20 return to their initial position as shown in FIGS. 13 and 14 due to their own weight. Therefore, the user can again place the soap S onto the tips 2011 of the plurality of bumps 201.

Figure 18:
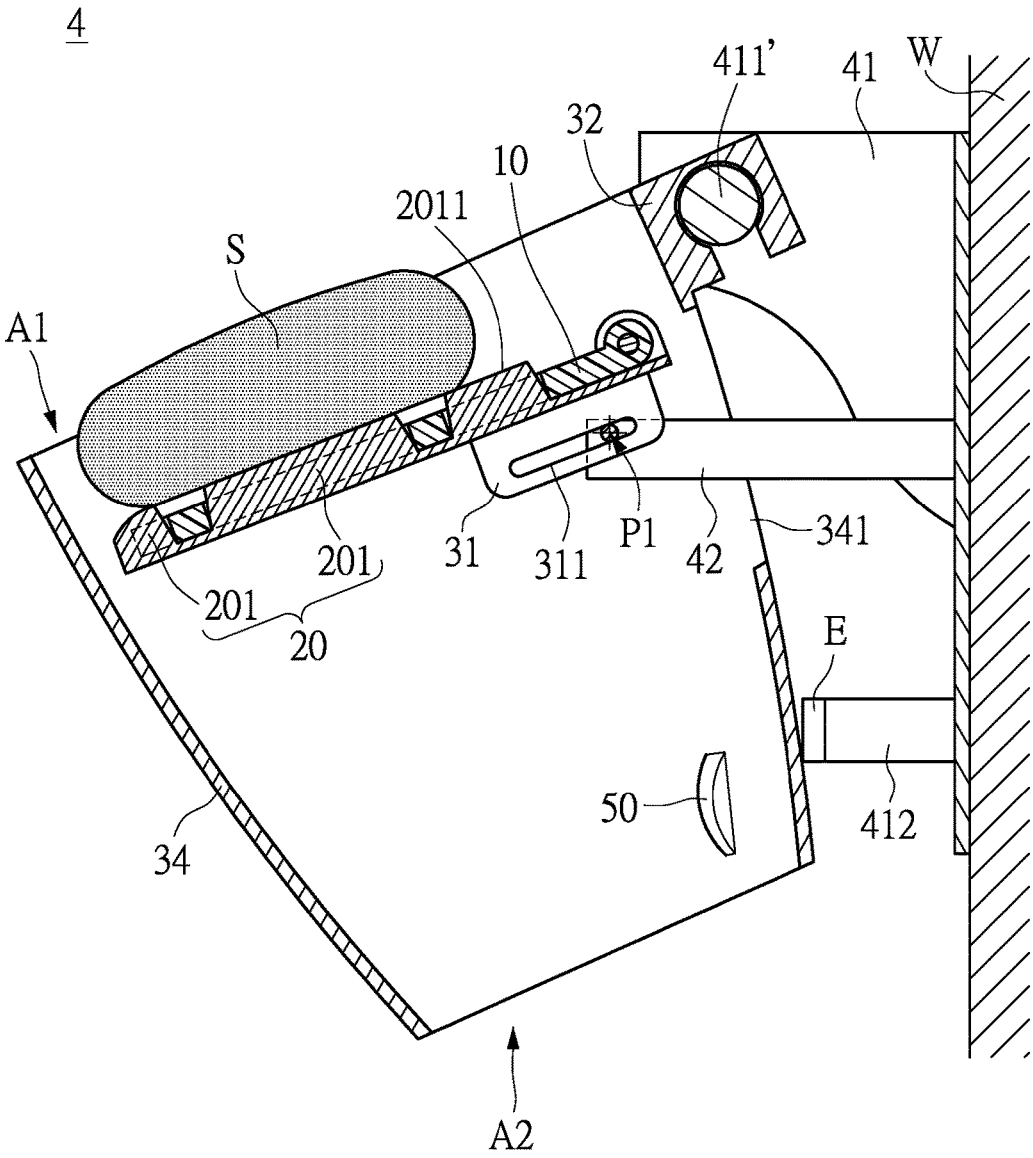
FIGS. 18 and 19 are lateral views of a soap holder according to a sixth embodiment of the present invention.
Figure 19:
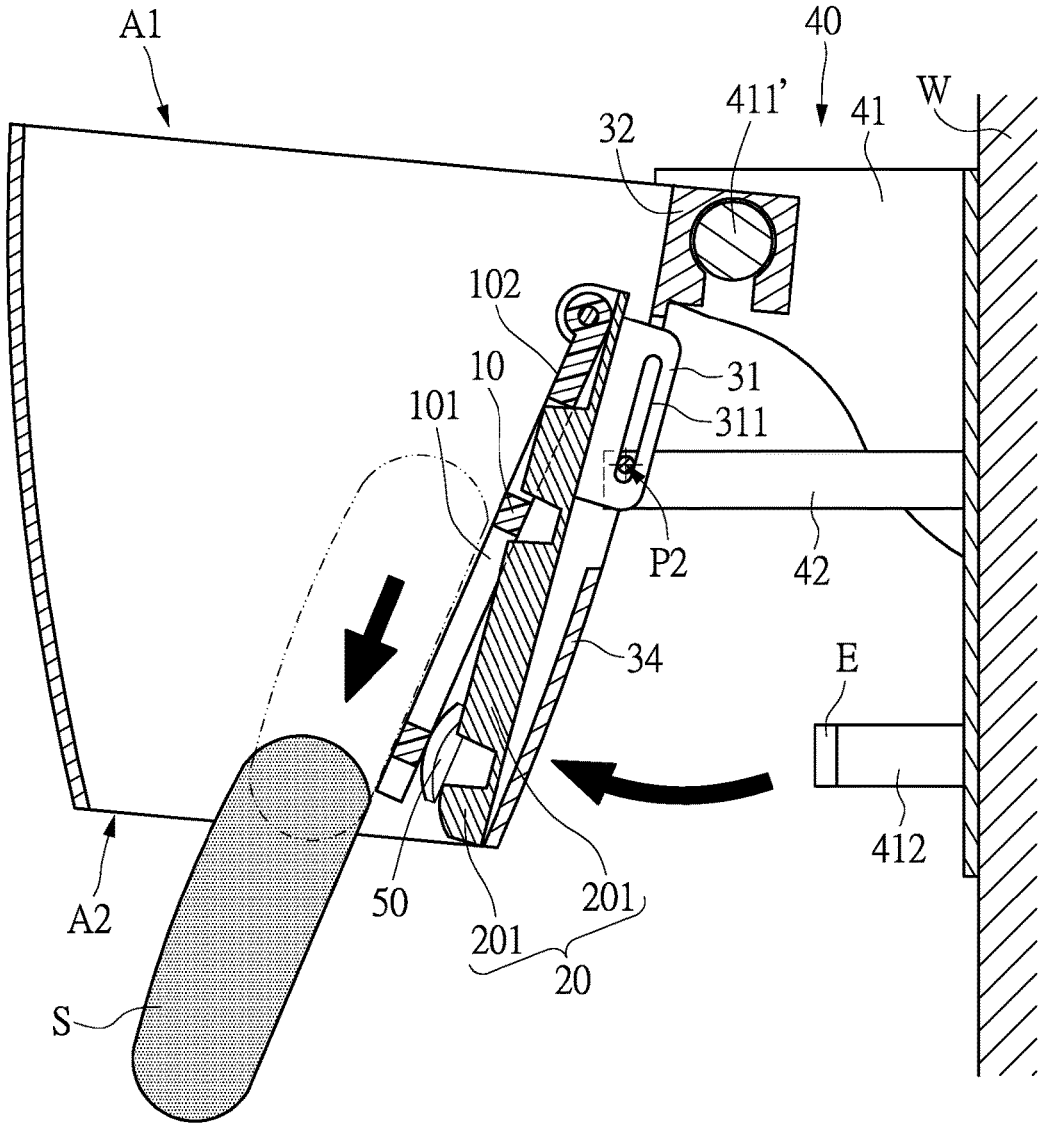

Refer to FIGS. 18 and 19 that show a soap holder according to a sixth embodiment of the present invention. The following describes the major differences between this embodiment and previous ones. In this embodiment, the soap holder 4 comprises a main body 10, a carrying plate 20, a linkage module 30, a fixation module 40 and a molded support 50. The main body 10 comprises a plurality of holes 101. The carrying plate 20 comprises a plurality of bumps 201, and each of the plurality of bumps 201 has a tip 2011. The linkage module 30 comprises a guiding module 31, a linkage 32 and a container 34. The linkage 32 is disposed on a top A1 of the container 34. The guiding module 31 comprises a slideway 311.

The fixation module 40 comprises a fixation 41 and a supporting arm 42. The fixation 41 further comprises a pivot joint 411' to connect the linkage 32. The fixation 41 also comprises a prop 412 disposed close to the inner side of the container 34 near the bottom A2. The molded support 50 is disposed on the interior surface of the container 34 near the bottom A2.

Referring to FIG. 18, when the bar of soap S is placed on the tips 2011 of the plurality of bumps 201, the supporting arm 42 passes through an opening 341 on the container 34 and an end portion 421 of the supporting arm 42 is in a first position P1 relative to the slideway 311. The inner side near the bottom of the container 34 props against the prop 412.

Referring to FIG. 19, when the user pulls the container 34 and makes the container 34 rotate away from the wall W (i.e., clockwise rotation in FIG. 19), the main body 10 and the carrying plate 20 rotate toward the wall W (i.e., counterclockwise rotation in FIG. 19). The molded support 50 passes through the carrying plate 20 and props against the main body 10, and the end portion 421 of the supporting arm 42 shifts to a second position P2 relative to the slideway 311. In this case, the main body 10 and the carrying plate 20 separate from each other, and the tips 2011 of the plurality of bumps 201 do not expose above the upper surface 102. Therefore, the soap S slides along the inclined upper surface 102 and drops onto the hand of the user by way of the opening at the bottom A2 of the container 34. After the soap S drops onto the hand of the user, the container 34 rotates back toward the wall W and props against the prop 412. Therefore, the main body 10 and the carrying plate 20 return to their initial position as shown in FIG. 18.

In special applications, a piezoelectric element E is disposed on a surface such that when any two elements, for example the linkage module 30 and the fixation module 40, impact each other when the soap holder is operated, the piezoelectric element E converts the impact energy to electrical energy and the electrical energy can be transmitted to or stored in external devices. The two elements that impact each other when the soap holder is operated can be, but are not limited to, the main body 10 and the carrying plate 20 (see FIG. 1), the linkage 32 and the fixation 41 (see FIGS. 7 and 8), the assistive linkage 33 and the fixation 41 (FIGS. 14 and 15) or the container 34 and the supporting arm 42 (FIGS. 18 and 19).

The descriptions illustrated supra set forth simply the preferred embodiments of the present invention; however, the characteristics of the present invention are by no means restricted thereto. All changes, alterations, or modifications conveniently considered by those skilled in the art are deemed to be encompassed within the scope of the present invention delineated by the following claims.

What is claimed is:

1. A soap holder, comprising:

a main body comprising a plurality of holes, an upper surface and a lower surface; and a carrying plate comprising a plurality of bumps, the carrying plate connected to one side of the main body by a hinge joint and locked to another side of the main body opposite to the hinge joint by a releasable retaining structure, each of the plurality of bumps having a tip, each of the plurality of bumps partially passing through a corresponding hole of the plurality of holes so the tip of each of the plurality of bumps is exposed above the upper surface and the tips of the plurality of bumps can carry a bar of soap when the main body and the carrying plate are locked together by the releasable retaining structure, wherein the main body and the carrying plate are separable by releasing the releasable retaining structure such that the bar of soap drops onto the upper surface of the main body as each of the plurality of bumps withdraws from the corresponding hole of the plurality of holes.

2. The soap holder according to claim 1, further comprising at least one elastic unit disposed over one side of the carrying plate, wherein the at least one elastic unit restores the lock between the main body and the carrying plate when the main body and the carrying plate are separated by an external force.

3. The soap holder according to claim 1, further comprising a linkage mechanism to fix the main body and the carrying plate on a plane, the linkage mechanism making the main body and the carrying plate separable so each of the plurality of bumps withdraws from the corresponding hole of the plurality of holes and the tip of each of the plurality of bumps is not exposed above the upper surface.

4. The soap holder according to claim 3, wherein the linkage mechanism comprises a linkage module and a fixation module; the linkage module, the main body, the carrying plate and the fixation module are hinged together; each of the plurality of bumps withdraws from the corresponding hole of the plurality of holes and the tip of each of the plurality of bumps is not exposed above the upper surface when an external force is applied over the linkage module; the fixation module is fixed on the plane.

5. The soap holder according to claim 4, further comprising a piezoelectric element disposed on a surface such that when the linkage module and the fixation module impact each other when the soap holder is operated, the piezoelectric element converts the impact energy to electrical energy.

* * * * *